US005201123A

United States Patent [19]

Booe

[11] Patent Number: 5,201,123

[45] Date of Patent: Apr. 13, 1993

[54] BOW SIGHTING APPARATUS

[76] Inventor: Eugene Booe, Rte. 2, Box 200, Yadkinville, N.C. 27055

[21] Appl. No.: 901,039

[22] Filed: Jun. 19, 1992

[51] Int. Cl.[5] ..... F47G 1/34
[52] U.S. Cl. ..... 33/265; 33/241
[58] Field of Search ..... 33/265; 124/87

[56] References Cited

U.S. PATENT DOCUMENTS

| | | | |
|---|---|---|---|
| 4,541,179 | 9/1985 | Closson | 33/265 |
| 4,638,565 | 1/1987 | Podany et al. | 33/265 |
| 5,048,193 | 9/1991 | Hacquet | 33/265 |
| 5,092,052 | 3/1992 | Godsey | 33/265 |

OTHER PUBLICATIONS

Cobra, "Accessories For Every Bowhunter" Catalog p. 2 Oct. 1987.

*Primary Examiner*—Harry N. Haroian
*Attorney, Agent, or Firm*—Leon Gilden

[57] ABSTRACT

An apparatus having a support plate mounted to a grip portion of a bow member, wherein the support plate includes a plurality of peep sights mounted thereon, each peep sight arranged in an associated slot, and each peep sight associated with various elevational hinges to permit sequential firing of an arrow at various elevational sights without recourse to continuous sight changes of the apparatus.

3 Claims, 4 Drawing Sheets

BOW SIGHTING APPARATUS

BACKGROUND OF THE INVENTION

1. Field of the Invention

The field of invention relates to bow sighting apparatus, and more particularly pertains to a new and improved bow sighting apparatus wherein the same is arranged for the positioning of a plurality of sighting members upon a mounting plate of an archery bow structure.

2. Description of the Prior Art

The use of archery equipment and an associated sighting structure for target and hunting purposes is utilized in the prior art as exemplified in U.S. Pat. No. 4,858,589. To permit an individual to accommodate various targets at various distances, the instant invention attempts to overcome deficiencies of the prior art by setting forth a plurality of sighting hoods and associated peep sight members mounted upon a single support plate secured to an associated archery bow.

Accordingly, it may be appreciated that there continues to be a need for a new and improved bow sighting apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bow sighting apparatus now present in the prior art, the present invention provides a bow sighting apparatus wherein the same is arranged to accommodate various distances by a single sighting structure. As such, the general purpose of the present invention, which will be described subsequently in greater detail, is to provide a new and improved bow sighting apparatus which has all the advantages of the prior art bow sighting apparatus and none of the disadvantages.

To attain this, the present invention provides an apparatus having a support plate mounted to a grip portion of a bow member, wherein the support plate includes a plurality of peep sights mounted thereon, each peep sight arranged in an associated slot, and each peep sight associated with various elevational hinges to permit sequential firing of an arrow at various elevational sights without recourse to continuous sight changes of the apparatus.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bow sighting apparatus which has all the advantages of the prior art bow sighting apparatus and none of the disadvantages.

It is another object of the present invention to provide a new and improved bow sighting apparatus which may be easily and efficiently manufactured and marketed.

It is a further object of the present invention to provide a new and improved bow sighting apparatus which is of a durable and reliable construction.

An even further object of the present invention is to provide a new and improved bow sighting apparatus which is susceptible of a low cost of manufacture with regard to both materials and labor, and which accordingly is then susceptible of low prices of sale to the consuming public, thereby making such bow sighting apparatus economically available to the buying public.

Still yet another object of the present invention is to provide a new and improved bow sighting apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
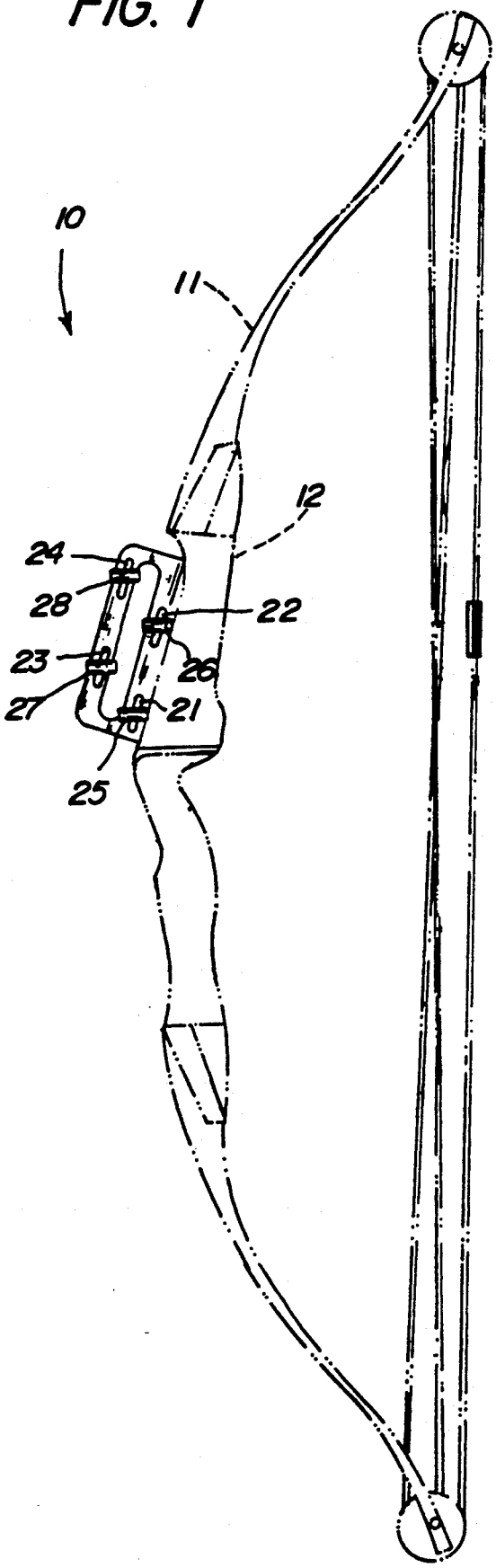
FIG. 1 is an orthographic view of the instant invention.
Figure 2:
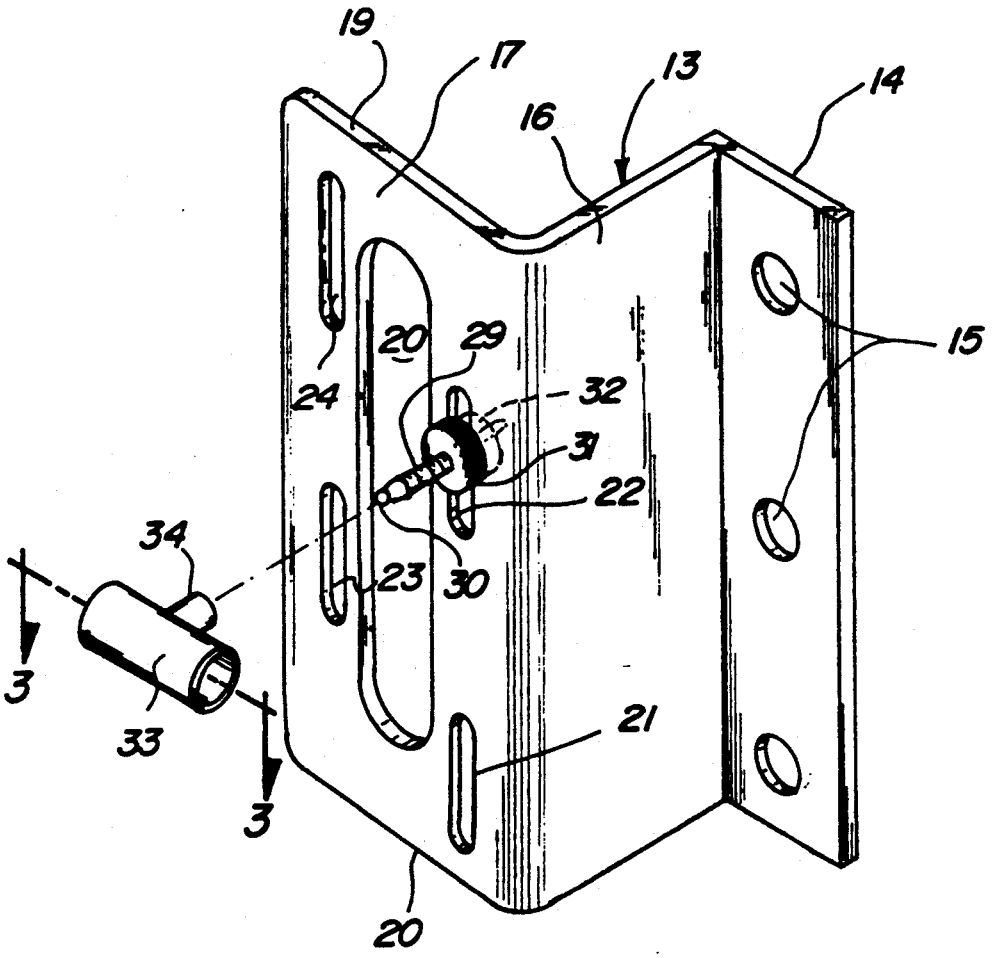
FIG. 2 is an isometric illustration of the support plate structure of the invention.
Figure 3:
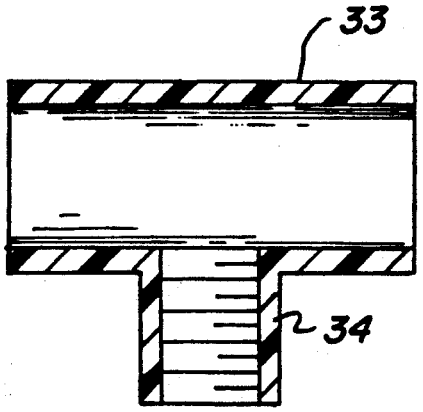
FIG. 3 is an orthographic view, taken along the lines 3—3 of FIG. 2 in the direction indicated by the arrows.
Figure 4:
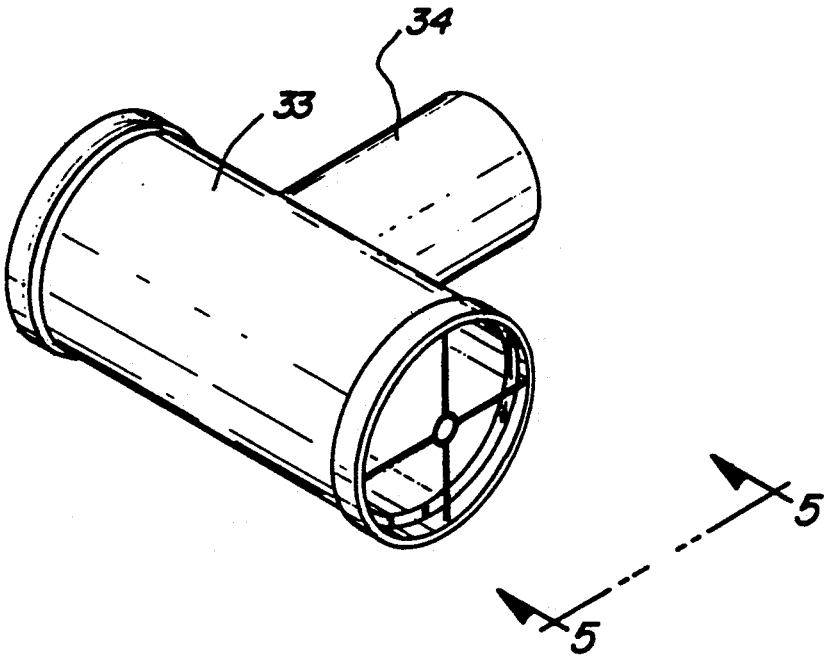
FIG. 4 is an isometric illustration of an individual bow sighting hood structure of the invention.
Figure 5:
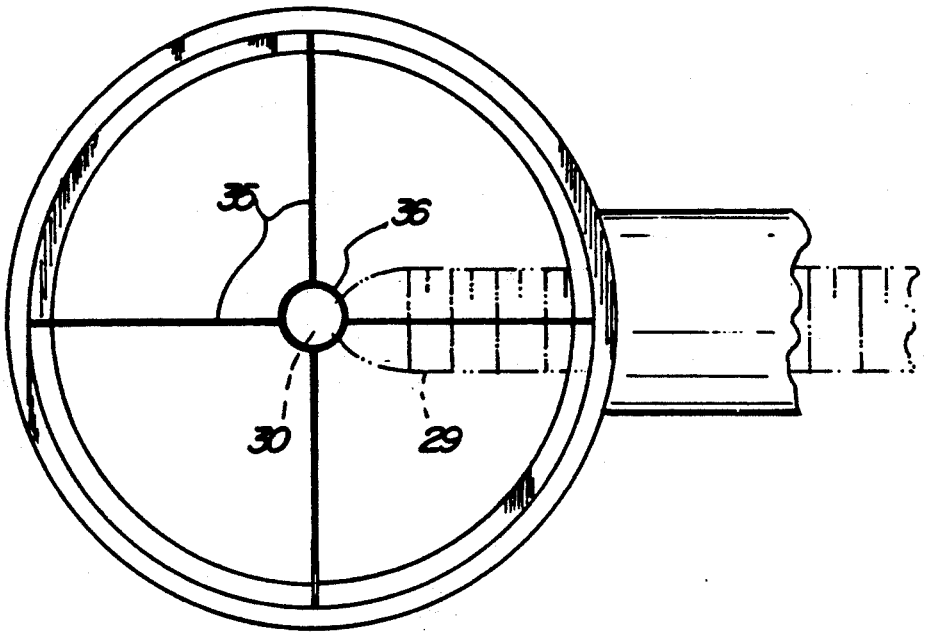
FIG. 5 is an orthographic view, taken along the lines 5—5 of FIG. 4 in the direction indicated by the arrows.

With reference now to the drawings, and in particular to FIGS. 1 to 7 thereof, a new and improved bow sighting apparatus embodying the principles and concepts of the present invention and generally designated by the reference numeral 10 will be described.

More specifically, the bow sighting apparatus 10 of the instant invention essentially comprises a bow 11 having a central grip portion side wall 12 of a generally planar configuration, with a support plate 13 (see FIG. 2) having a first side wall 14 integrally joining a second side wall 16, in turn joined to a third side wall 17 to define a generally S-shaped support plate 13. The first side wall 14 includes first side wall mounting apertures 15 to permit directing of fasteners (not shown) of conventional construction directed through the side wall mounting apertures 15 into the grip portion of the bow 11. The third side wall 17 is formed with a third side wall top edge 18 spaced from a third side wall bottom edge 19 having a handle slot 20 orthogonally directed between the top and bottom edges 18 and 19 oriented substantially medially of the side edges of the third side wall 17. The third side walls further include third side wall first, second, third, and fourth sight mounting slots 21, 22, 23, and 24 that are arranged in a parallel relationship relative to one another, with the first and second slots 21 and 22 longitudinally aligned on a first side of the handle slot 20, with the third and fourth sight mounting slots 23 and 24 positioned on a second side of the handle slot 20. The third and fourth sight mounting slots are arranged in a longitudinally aligned relationship. Should clearance permit, the slots 21–24 may be positioned on a single side of the handle slot, but it is understood that such invites interference between the various sighting hoods arranged within the associated sight mounting slots.

Each of the sight mounting slots includes a sighting pin 29 that is externally threaded orthogonally oriented relative to the third side wall, with each sighting pin 29 having a first and second fastener 31 and 32 positioned on opposed sides of the third side wall, with the sighting pin 29 positioned within the associated sight mounting slot to permit vertical adjustment of each sighting pin. A sight tube 33 is arranged to have a mounting tube 34 orthogonally intersecting each sight tube 33 in communication with an interior cavity of each sight tube 33, with the mounting tube 34 internally threaded to threadedly receive the sight pin 29. The sighting pin 29 is of a predetermined length to medially position an associated sighting sphere 30 at a forward distal end of each sight pin 29 within each sight tube 33 in a coaxially aligned relationship relative to cross hairs 35 that intersect at an intersection 36 to thereby position the sighting sphere 30 in a coaxially aligned relationship to the intersection 36. In this manner, the four sighting tubes provide for a sighting tube oriented relative to each sight mounting slot to permit accommodation of various distances in an archery situation such as 20, 30, 40, and 50 yard targets for example.

Figure 6:
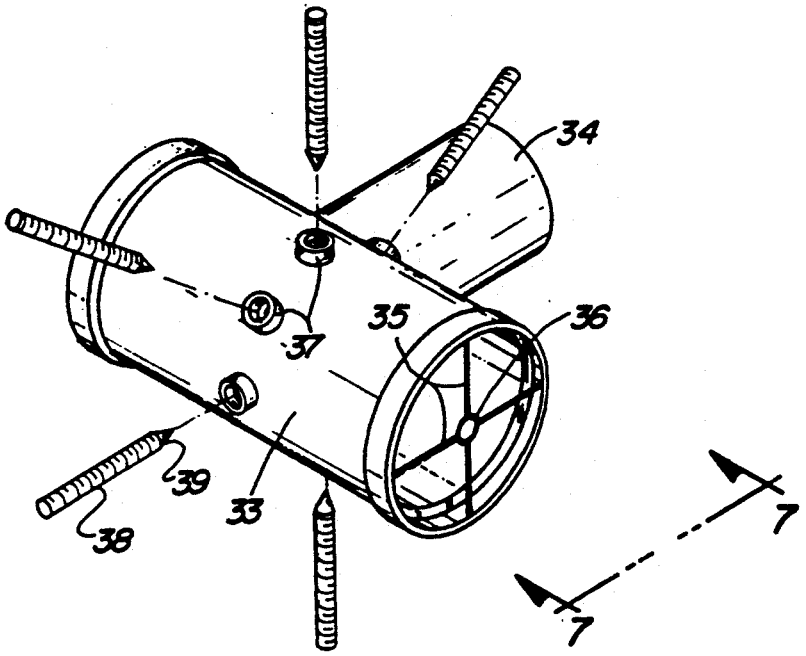
FIG. 6 is an isometric illustration of a modified bow sighting hood structure.
Figure 7:
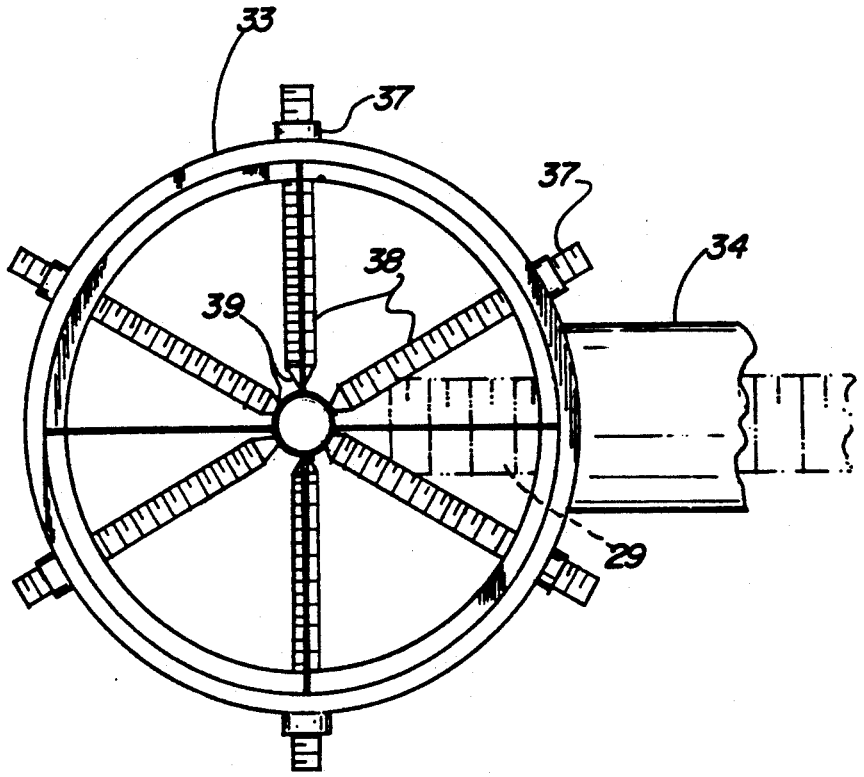
FIG. 7 is an orthographic view, taken along the lines 7—7 of FIG. 6 in the direction indicated by the arrows.

The FIGS. 6 and 7 are arranged to be provided with an annular array of internally threaded adjuster tubes 37 mounted to the sight tube 33, with each of the adjuster tubes 37 radially directed interiorly of the sighting tube 33 between the cross hairs 35 and the mounting tube 34. Each adjuster rod 38 has a luminescent tip 39 to provide for enhanced visibility of the peep sight structure during conditions of limited available light. In this manner, repositioning of the adjuster rods permits for variation and highlighting of the intersection of the cross hairs to accommodate various individual differences in a sighting procedure through an associated sight tube 33.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bow sighting apparatus, comprising, a bow member, the bow member having a central grip portion, with the central grip portion including a side wall, and a support plate, the support plate including a first side wall and a second side wall integrally and orthogonally mounted to the first side wall, and a third side wall integrally and orthogonally mounted to the second side wall, when the first side wall, the second side wall, and the third side wall define a serpentine configuration, with the first side wall mounted to the central grip portion, and the third side wall coplanar with the grip portion side wall, and the third side wall including a third side wall top edge and a third side wall bottom edge, and a handle slot orthogonally directed through the third side wall between the third side wall top edge and the third side wall bottom edge, and a first and a second sight mounting slot directed through the third side wall adjacent the handle slot on a first side of the handle slot, with the first sight mounting slot and the second sight mounting slot longitudinally aligned, and a first sight member mounted to the first sight mounting slot and a second sight member mounted to the second sight mounting slot, and a third sight mounting slot and a fourth sight mounting slot longitudinally aligned relative to one another and directed through the third side wall on a second side of the handle slot, wherein the first sight mounting slot, the second sight mounting slot, the third sight mounting slot, and the fourth sight mounting slot are arranged in a parallel relationship, and a third sight member mounted to the third sight mounting slot and a fourth sight member mounted to the fourth sight mounting slot, and the sight member includes a sight hood, and a mounting tube orthogonally intersecting the sight hood, the mounting tube internally threaded, and an externally threaded sight pin threadedly received within the mounting tube, and the sight pin including a first fastener and a second fastener to secure the sight pin to the third side wall, and the sight pin including a sighting sphere, with the sighting sphere positioned medially of the sight tube.

2. An apparatus as set forth in claim 1 including cross hairs mounted to each sight hood, the cross hairs having an intersection, and the sighting sphere coaxially aligned with the intersection.

3. An apparatus as set forth in claim 2 including an annular array of internally threaded adjuster tubes mounted to the sight hood, with each adjuster tube radially aligned relative to the sight hood, and each adjuster tube having an adjuster rod, each adjuster rod including a luminescent tip and the adjuster tubes are positioned between the mounting hood and the cross hairs.

* * * * *